United States Patent [19]

Lööf

[11] Patent Number: 5,011,085

[45] Date of Patent: Apr. 30, 1991

[54] APPARATUS IN A POWDER SPRAYER

[75] Inventor: Ingemar Lööf, Skillingaryd, Sweden

[73] Assignee: AC Greiff Ytbehandling AB, Nacka, Sweden

[21] Appl. No.: 424,308

[22] PCT Filed: Apr. 18, 1988

[86] PCT No.: PCT/SE88/00199

§ 371 Date: Nov. 16, 1989

§ 102(e) Date: Nov. 16, 1989

[87] PCT Pub. No.: WO88/08332

PCT Pub. Date: Nov. 3, 1988

[30] Foreign Application Priority Data

Apr. 28, 1987 [SE] Sweden ..... 8701776

[51] Int. Cl.[5] ..... B05B 5/47

[52] U.S. Cl. ..... 239/690; 239/706; 118/629

[58] Field of Search ..... 239/690, 692, 704, 706; 118/629; 427/27; 361/225-228

[56] References Cited

U.S. PATENT DOCUMENTS 3,735,925 5/1973 Benedek et al. ..... 427/27
4,706,890 11/1987 Talacko ..... 239/692
4,747,546 5/1988 Talacko ..... 239/704

FOREIGN PATENT DOCUMENTS 0314049 5/1989 European Pat. Off. ..... 239/692
2583310 12/1986 France ..... 239/692
446824 10/1986 Sweden .

*Primary Examiner*—Andres Kashnikow
*Assistant Examiner*—Karen B. Merritt
*Attorney, Agent, or Firm*—Oblon, Spivak, McClelland, Maier & Neustadt

[57] ABSTRACT

A sprayer intended for powder coating is provided with an annular friction charging channel (9) for electrostatic charging of the powder. The charging channel is defined partly by an inner longitudinal body (8) of non-conductive material, and partly by an outer tube (7) of the same material, there being disposed, extremely on the tube (7) an electric conductor (13, 14). To improve the charging of the powder and prevent discharging in the sprayer, there is provided centrally within the longitudinal body (8) a longitudinal electric conductor (11) which is electrically connected to the outer conductor (13, 14). The outer conductor (14) is of a length and constructional design which encloses the entire sprayer and the inner conductor (11) extends throughout the entire length of the channel (9).

5 Claims, 3 Drawing Sheets

APPARATUS IN A POWDER SPRAYER

TECHNICAL FIELD

The present invention relates to an apparatus in a powder sprayer which includes an annular, friction charging channel defined by an inner longitudinal body with a surface of electrically insulating material and a tubular body surrounding the inner longitudinal body, with an inner surface of electrically insulating material, the channel being surrounded by an outer electric conductor.

BACKGROUND ART

Swedish Patent Application 8500530-4 discloses a powder sprayer in which use is made of an elongate, annular charging channel which is inwardly defined by an elongate rod of insulating material and which is outwardly defined by a tubular body of insulating material.

In certain cases, a sprayer of this configuration may function satisfactorily, but it suffers, not least, from the drawback that the powder cloud emitted from the nozzle at the discharge end of the gun shows a tendency to 'kick back' onto the external surfaces of the gun so that a considerable amount of powder is deposited there. Furthermore, the charging level will be uneven, and, in certain powder qualities, so low that satisfactory powder coating cannot be achieved.

Swedish Printed Application 446 825 discloses another type of powder sprayer which includes a plurality of irregularly bent charging channels of insulating material through which a powder-air mixture is positively forced for charging the powder. Each one of these irregularly bent charging channels has on its outside an electrically conductive layer.

The construction according to this Printed Application also suffers from considerable drawbacks, partly in that the charging result will not be satisfactory, and partly in that the powder spraygun is constructed in such a manner that it is as good as impossible to clean in conjunction with change of powder quality.

Further problems which are inherent in prior art powder sprayguns reside in the fact that such high tensions have locally been formed in the gun that spark formation or discharges more or less of the light-arc nature have occurred in or at the gun. If such discharges have taken place in contact with the powder in the gun, in certain cases the powder has melted or sintered to form a large aggregate which has caused operational disruptions or a poor end result.

OBJECTS OF THE INVENTION

The present invention has for its object to realise a powder spraygun of the type disclosed by way of introduction, the powder spraygun being designed in such a manner as to provide extremely good and uniform charging results irrespective of the quality of the discharged powder. The present invention further has for its object to realise a powder spraygun of the type disclosed by way of introduction which is constructed in such a manner that it is extremely easy to manufacture and keep clean, and that it wholly obviates the risk that the discharged powder cloud will 'kick back' and adhere exteriorly on the spraygun. Finally, the present invention also has for its object to realise an apparatus which is designed in such a manner that the risk of discharges and light-arcs in or at the powder spraygun is wholly eliminated.

SOLUTION

The objects forming the basis of the present invention will be attained if the apparatus intimated by way of introduction is characterised in that there is disposed, inside the annular channel, an inner electric conductor which is electrically connected to the outer conductor.

According to one preferred embodiment of the present invention, the outer conductor is suitably of a length which is sufficient to cover substantially the entire length of the spraygun. Furthermore, the inner conductor is, according to this preferred embodiment, disposed centrally interiorly in the inner body throughout substantially the entire length thereof.

As a result of these constructional features, a high grade and uniform charging of the powder passing through the powder spraygun will be achieved and, furthermore, the risk that the powder cloud 'kicks back' on the powder spraygun is effectively obviated. These constructional features also entail complete safety against discharges interiorly in or at the powder spraygun so that, thereby, the risk that the powder melts or sinters together to form large lumps is eliminated, as well as the risk of fire or explosion.

For constructional and functional reasons, it suitably applies according to the invention that the inner conductor is provided with an end portion which extends out from the end of the inner body turned to face an inlet channel to the spraygun, and that this end portion is spiculated. The possibility will hereby be ensured of simple electric interconnection of the inner and outer conductors, as well as superior flow conditions interiorly in the spraygun. This embodiment of the present invention is suitably also characterized in that the inner body is produced from a number of tubular sections which accommodate the inner conductor and which are united and held together by the conductor. As a result of these constructional features, manufacture of the powder spraygun will be extremely simple, and in addition the spraygun may easily be cleaned in conjunction with a change of powder quality.

A suitable design of the outer conductor is characterized, according to the present invention, in that the outer conductor consists of an electrically conductive powder layer on the outer surface of the tubular body, and a metal conductor disposed on the powder layer, the metal conductor being urged against the powder layer by means of a surrounding layer of insulating material.

BRIEF DESCRIPTION OF THE ACCOMPANYING DRAWINGS

The nature of the present invention and its aspects will be more readily understood from the following brief description of the accompanying Drawings, and discussion relating thereto.

Figure 4:
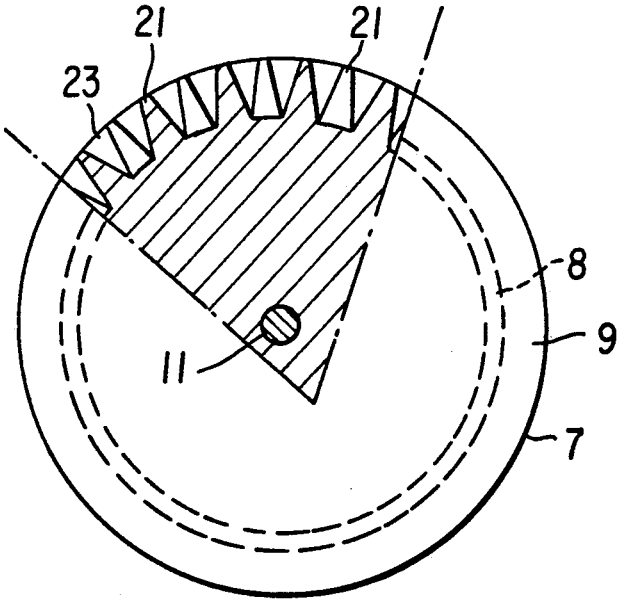
Figure 3:
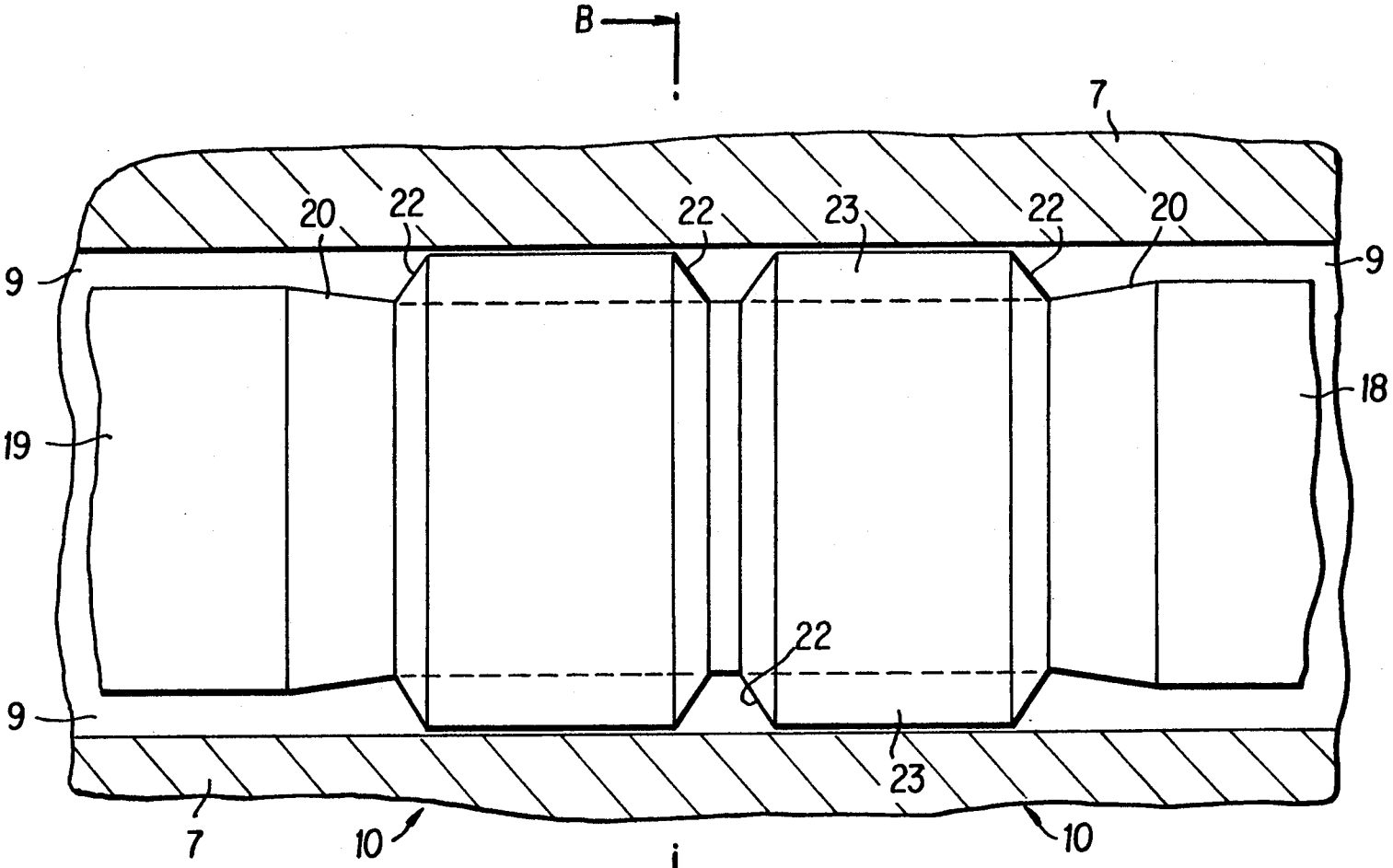

FIG. 3 schematically illustrates, on a larger scale, two mutually subsequent turbulence members according to the invention; and FIG. 4 is a section taken along the line B—B in FIG. 3.

DESCRIPTION OF PREFERRED EMBODIMENT

Figure 1:
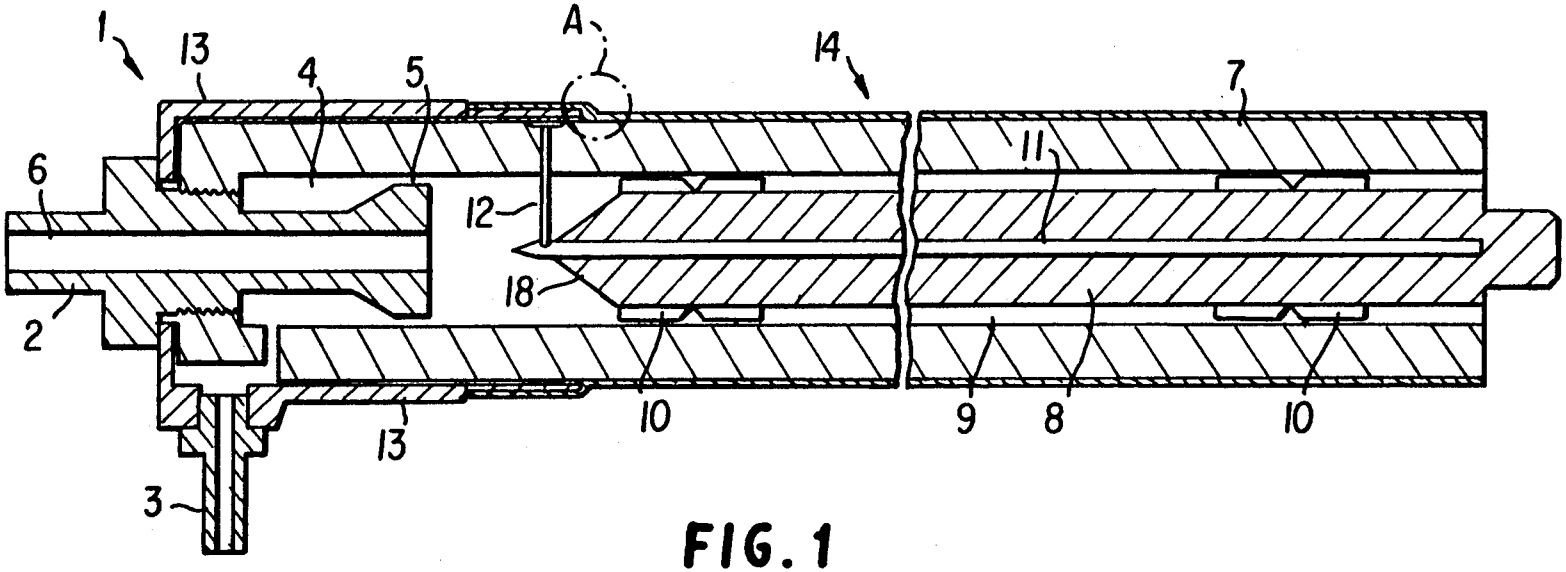
FIG. 1 is a longitudinal, approximately diametric cross-section through the subject matter of the present invention.

Referring to the Drawings, FIG. 1 shows a schematic longitudinal cross-section through the powder spraygun, the right-hand end thereof being intended for mounting of a spraynozzle which, as evenly as possible, distributes a powder-air mixture passing through the powder spraygun for charging of the powder.

In the left-hand end of the Figure, the powder spraygun has an inlet device 1 with an inlet nipple 2 for connection to a hose conduit through which a fluidised mixture of powder and air is passed. There is further provided an air inlet 3 for the regulated supply of extra air, this air being led, through a channel system, into an annular space 4 in order to flow out therefrom via an annular gap 5 and be mixed with the major flow of air and powder which is emitted centrally via the channel 6.

The powder spraygun proper consists of an outer tubular body or a tube 7 of electrically insulating material, preferably Teflon ®. Possibly, the tubular body 7 may also consist of another, for example electrically conductive material and be coated interiorly with a layer of electrically insulating material, for example Teflon ® or other suitable plastics material. Interiorly in the outer body or tube 7, there is disposed an inner rod-shaped body 8 or core which also consists of an electrically insulating material, preferably of the same material as the electrically insulating material of the outer body or tube. The inner core 8 is of slightly smaller outer diameter than the inner diameter of the outer body or tube, so that there is formed, between these two parts, a friction charging channel 9 in the form of an annular channel. The inner core 8 is centered in the tube 7 in that the inner core is provided with a number of centering members 10 which also serve as turbulators. The centering members or turbulators 10 are, therefore, shaped as screws with large pitch or as gear wheels with helically cut cogs, such that there is formed a number of channels which are helically configurated or are obliquely inclined in relation to the longitudinal direction of the gun, these channels placing the different sections of the charging channel in communication with one another. As a result, the centering members or turbulators 10 will impart a rotary movement to the powder-air mixture which flows in the charging channel, so that the flow pattern will be turbulent and vortical, whereby the powder particles will come into improved contact with the channel walls.

A more detailed description of the turbulators 10 will be given below.

An inner conductor 11 of metal such as brass, copper, silver or the like is embedded or otherwise disposed interiorly in the inner body 8 or core, the conductor 11 being in the form of a longitudinal rod extending throughout substantially the entire length of the inner body 8. The end of the inner conductor facing the inlet device 1 is spiculated to a tip and is there in electric contact with contact springs 12 which are preferably manufactured of metal. The contact springs 12 are anchored in and extend through the outer tube 7 and are, on the outside thereof, in electric communication with a hood 13 which is manufactured of metal and surrounds the inlet device 1 and a portion of the outer tube 7. The hood 13 and the inner conductor 11 will hereby be in electric contact with one another.

Figure 2:
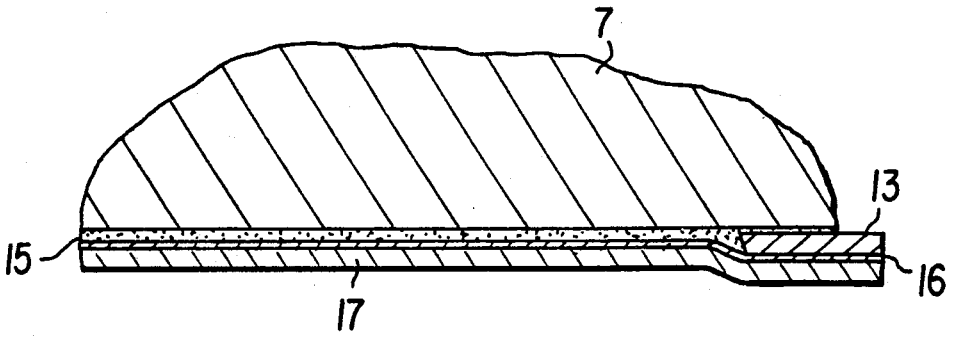
FIG. 2 is a part magnification of the area ringed A in FIG. 1.

On the outside of the outer tube 7, there is disposed an outer electric conductor 14 whose detailed construction is more readily apparent from FIG. 2. The outer conductor 14 is electrically well-connected to the hood 13, is tubular and extends along substantially the entire outer surface of the tube 7. Hereby, the outer conductor 14 will surround the annular charging channel 9 substantially throughout its entire length. Correspondingly, the annular charging channel will surround the inner conductor 11, also throughout substantially the entire length of the annular charging channel.

FIG. 2 shows a large-scale magnification of the ringed portion of FIG. 1 marked A. It will be apparent from FIG. 2 that the hood 13 connects to the outer tube 7 as closely as is practically feasible. Furthermore, there is disposed on the outer surface of the tube 7 a layer 15 of a pulverulent electric conductor such as graphite, metal particles, carbon particles or the like. Outside the conductive pulverulent layer 15, there is disposed a metal foil, metal tube, metal mesh or some similar powerfully electrically conductive material which may be of relatively weak material so that it is readily deformable but nevertheless sufficiently robust to provide a good electric conductive capacity. In the illustrated embodiment, use is made of a metal foil which has reference numeral 16 and connects to the outside of the hood 13. On the outside of the metal foil 16, there is provided a shrink-on hose of plastics material which is shrunk on about the metal foil, the hood 13 and the pulverulent conductive layer 15. As a result of the relatively large shrink-on force of the shrink-on hose 17, an extremely intimate contact will be established between the pulverulent layer 15 and the outer tube 7, which, in the Figure, is intimated in that the pulverulent layer 15 is partly shown as embedded in the outer peripheral surface of the tube 7. In the same manner, there will be established, as a result of the effect of the shrink-on hose, good electric contact between the pulverulent layer 15 and the superjacent metal foil 16. Naturally, good electric contact will also be ensured between the metal foil 16 and the hood 13.

As was intimated above, the outer tube 7 need not be a thick-walled tube of plastics material. Instead, the outer tube may be a metal tube which is provided with an interior lining of the relevant plastics material. Hereby, the pulverulent layer 15 and the metal foil 16 could be dispensed with, if the outer metal tube is electrically connected to the hood 13 or its counterpart, and, in addition, to the inner conductor 11.

While not being apparent from the Drawing, the hood 13 is suitably provided with an electric connection terminal so that the inner and outer conductors may have the same potential and, moreover, a potential which is linked to earth or to the object which is to be sprayed.

As was briefly mentioned above, the purpose of the turbulators 10 is partly to realise the favorable turbulence in the powder-air mixture as it passes through the charging channel 9, and partly to center the inner body or core 8 with the inner conductor 11. For practical reasons, the outer tube or body 7 should be interiorly cylindrical, whereby all turbulators may be of the same dimensions.

For manufacturing reasons, the inner core 8 is suitably divided into a number of sections in mutual sequence and produced as separated parts. These parts are then joined together in that they are provided with a central bore for accommodating the inner conductor 11 which, in its turn, holds together the whole of the inner core 8 by means of a thread connection or other suitable provision.

According to the present invention, the turbulators are arranged in groups of two and two, or more, in mutual sequence. A plurality of such groups may be disposed along the inner body or core 8 and, in one practical embodiment, three groups each of two turbulators have proved suitable. The first group of turbulators 10 (most proximal the inlet device 1) is disposed immediately adjacent an inlet cone 18 to the charging channel 9. This inlet cone 18 may, in a practical design, be provided with an inner thread which cooperates with a mating thread on the inner conductor 11 so that, thereby, the inlet cone 18 may function as a nut which unites the whole of the inner core 8.

At its major end, the inlet cone 18 is of slightly smaller diameter than the major portion of the inner body or core 8, so that, thereby, the charging channel 9 will have a slightly larger radial extent immediately ahead of the first turbulator 10. Correspondingly, the charging channel is of slightly greater radial depth immediately after the turbulators. This feature is achieved in that the parts 19, in addition to the turbulators 10 and the inlet cone 18, of which the inner core 8 is composed are provided with conical conical or tapering portions 20 whose smallest diameter approximately corresponds to the diameter of the major end of the inlet cone 18.

Each turbulator 10 includes a number of turbulence members 21 which are in the form of vanes projecting out from the inner core 8 and are uniformly distributed about the inner core so that there are formed, between adjacent vanes, through flow channels 23 which guide the powder flow into a vortical flow pattern. The radially outer portions of the vanes are formed to adhere to the contour of the inner surface of the tubular body 7, and the longitudinal direction of the vanes is obliquely inclined, or makes an angle with the longitudinal direction of the charging channel 9. Furthermore, the vanes 21 may be either approximately straight or arched such that the pitch of the vanes will either be constant throughout the entire length, or increase or decrease along this length.

In order that the flow resistance through the turbulators is not excessively great, it is appropriate that the end surfaces 22 of the vanes (as is apparent from FIG. 3) make an angle with a diametric plane to the inner core 8 such that, thereby, the leading and trailing surfaces of the turbulators 10 in the flow direction will be approximately conical. Furthermore, the end surfaces 22 should be rounded or spiculated.

According to the invention, the through flow channels located between the vanes 21 should have larger cross-sectional areas than is the case for the material cross-section in the vanes. Furthermore, the vanes are suitably slightly broader at their root portions than at their outer portions. The total of the through flow areas in each turbulator should approximately correspond to the through flow area in the charging channel 9, which has been realised in that the channels in the turbulators are of greater radial extent than is the case for the annular charging channel 9.

It will also be apparent from FIG. 3 that the turbulators 10 disposed in groups of two have therebetween a short gap so that there is formed an annular space between proximally located end surfaces 22. Furthermore, the turbulence members or vanes 21 are offset in the circumferential direction on proximally located turbulators, whereby, for example, the end surfaces 22 will be located in register with the through flow channels 23 on the adjacent turbulator. Naturally, other mutual offset relationships may also be employed, even though the above-mentioned configuration has proved to be sufficient for its purpose.

Since the sole object of the through flow channels 23 is to create turbulence, and a possible helical flow pattern in the charging channel 9, the through flow channels 23—and consequently also the vanes 21—need not be of excessively great axial length. Practical experiments have shown that a length along the longitudinal direction of the charging channel 9 of approximately the same order of magnitude as the inner diameter of the outer body 7 is suitable. Furthermore, experiments have demonstrated that an angle of pitch, i.e. the angle between the longitudinal direction of the vane 21 and a plane at right angles to the longitudinal direction of the charging channel 9 of approximately 45° for the vanes 21 is suitable, even though other angles of pitch—appropriately in the range of between 30° and 60°—may also be employed.

If different angles of pitch for the vanes 21 are relevant, the selection of angles of pitch should suitably be placed in relationship to the axial flow rate in the annular charging channel such that a high axial flow rate requires a greater angle of pitch for the vanes, and vice versa.

While not being apparent from the Drawings, the pitch for all of the turbulators faces in the same direction, so that, thereby, the flow through the annular charging channel will follow a helical course with rotation in the same direction throughout the entire length of the channel 9. However, it is naturally conceivable to switch the direction of pitch of the turbulators so that the rotation will be counter-directed along different portions of the annular charging channel 9.

In order to adapt the turbulators to the flow pattern which prevails at each respective turbulator, it is also possible to provide a large pitch for those turbulators which lie most proximal the inlet device (where the flow is substantially axial) and then gradually reduce the pitch the further away from the inlet device the turbulator in question is located (where the flow already rotates). Hereby, the pitch which the rotating flow experiences in the channel 9 could become approximately constant for all turbulators.

The present invention should not be considered as restricted to that described above and shown on the Drawings, many modifications being conceivable without departing from the spirit and scope of the appended claims.

I claim:

1. An apparatus in a powder sprayer comprising an annular friction charging channel (9) defined by an inner, longitudinal body (8) with a surface of electrically insulating material, and a tubular body (7) surrounding the inner body with an inner surface of electrically insulating material, the channel being surrounded, radially beyond the insulating material of the tubular body, by an outer electric conductor (14), characterised in that there is disposed, inside the annular channel (9) and inside the insulating material of the longitudinal body (8), an inner electric conductor (11) which is electrically connected (12) to the outer conductor (14) and that the inner electric conductor extends along substantially the whole length of the charging channel (9).

2. The apparatus as claimed in claim 1, characterised in that the outer conductor (13, 14) is of a length which covers substantially the entire length of the sprayer.

3. The apparatus as claimed in claim 1 or 2, characterized in that the inner conductor (11) is disposed centrally interiorly in the inner body (7).

4. The apparatus as claimed in claim 1 or 2, characterised in that the inner conductor (11) is provided with an end portion which extends out from the end (18) of the inner body (7) turned to face an inlet channel (6) to the sprayer; and that this end portion is spiculated.

5. The apparatus as claimed in claim 1 or 2, characterised in that outer conductor (14) comprises an electrically conductive powder layer (15) on the outer surface of the tubular body (7), and a metal conductor (16) disposed on the powder layer and urged against the powder layer by means of a surrounding layer (17) of insulating material.

* * * * *